United States Patent [19]

Warwick

[11] Patent Number: 4,498,694

[45] Date of Patent: Feb. 12, 1985

[54] DOOR REPAIR SYSTEM

[76] Inventor: David R. Warwick, P.O. Box 202, Lafayette, Calif. 94549

[21] Appl. No.: 547,731

[22] Filed: Oct. 31, 1983

[51] Int. Cl.[3] ..... E05C 21/00

[52] U.S. Cl. ..... 292/337

[58] Field of Search ..... 292/1, 337, 346, 357; 49/502, 503

[56] References Cited

U.S. PATENT DOCUMENTS

| | | | |
|---|---|---|---|
| 180,894 | 8/1876 | Leach . | |
| 231,688 | 8/1880 | Parker . | |
| 1,483,333 | 2/1924 | Capice . | |
| 2,238,066 | 4/1941 | Manty | 292/337 |
| 2,263,772 | 11/1942 | Gold | 70/451 |
| 3,647,252 | 3/1972 | Nolin et al. | 292/357 |
| 3,666,309 | 5/1972 | Zarzycki | 292/337 |
| 3,673,605 | 6/1972 | Allenbaugh | 292/346 |
| 4,139,999 | 2/1979 | Allenbaugh | 292/337 X |

FOREIGN PATENT DOCUMENTS 1011308 6/1952 France .

*Primary Examiner*—Richard E. Moore
*Attorney, Agent, or Firm*—Robert R. Tipton

[57] ABSTRACT

A door repair device utilizes a generally rectangular U-shaped member adapted to enclose and engage the edge of a door proximate the latch and door handle location. The door latch mechanism is mounted on the saddle portion of the U-shaped member with a latch plate sandwiched between the door latch mechanism and the inside surface of the saddle portion. A tubular extension member is combined with a machine screw and fastener member to provide a means for countersinking the head of the fastener making it flush with the outside surface of the generally flat saddle portion of the U-shaped member.

2 Claims, 4 Drawing Figures

DOOR REPAIR SYSTEM

BACKGROUND OF THE PRIOR ART

This invention relates generally to door lock hardware and in particular to door lock hardware universally adaptable to various makes and sizes of door latch hardware.

In general, the door latch repair and installation devices of the prior art were designed and adapted to imitate the undamaged door whereby a latch plate was attached and mounted flush with the outside edge of the door and recessed into the edge to provide a generally flat surface that would not interfere with the door jamb and striker plate mounted thereon.

One generally U-shaped, rectangular member utilized in the prior art door repair devices utilized a recessed portion in its outer flat saddle area adapted to receive the latch plate and be mounted thereon in a manner similar to a standard door not utilizing the U-shaped member.

Other door repair systems utilized a section that was adapted to fit into a cut-out portion of the door proximate the latch and door handle area.

In general, the problem associated with these prior art devices involved excessive manufacturing costs necessitated by attempting to match the typical configuration of the undamaged door.

SUMMARY OF THE INVENTION

The device of the present invention comprises, basically, a generally rectangular U-shaped member adapted to enclosed and engage the edge of a door proximate the latch and door handle location, the U-shaped member comprising a pair of extended leg members and a saddle portion, the saddle portion defining, initially, a generally flat surface on its inner and outer surfaces. A hole, adapted to receive a door handle latch actuator mechanism, is provided in each of the leg members and further hole is provided in the saddle portion adapted to permit the sliding latch-bolt member pass therethrough. A latch plate is adapted to engage the inside surface of the saddle portion between the leg members, the latch plate having holes proximate each end, countersunk with the countersunk region projecting inwardly into the saddle portion coincident with a pair of holes in the saddle portion.

A latch apparatus housing having a pair of fastening ears proximate the base thereof is adapted to align coincidentaly with the holes in the latch plate and are deformed to define a countersunk area adapted to nest with the countersunk region of the latch plate fastening holes. An extension member defining a generally hollow cylindrical shaft has one end adapted to engage the outwardly projecting edge portion of countersunk hole in said door latch mechanism housing ears with its other end adapted to engage the underside of the head of a machine screw. The machine screw is adapted to engage a fastening member passing through one of the fastening holes in the saddle portion, the head of the fastening member having a tapered side and flat head whereby tightening of the machine screw pulls the fastener into engagement with the edge of the hole in the saddle portion and deforms the edge to a countersunk position to match or nest with the countersunk portion of the hole in said latchplate whereby the head of the fastening member is flush with the surface of the saddle portion.

It is, therefore, an object of the present invention to provide a device for repairing a door and latch assembly.

It is a further object of the present invention to provide a door repair device requiring fewer steps in its manufacture.

It is still a further object of the present invention to provide a door repair device utilizing a generally rectangular U-shaped member having a pair of leg portions extending at right angles to a generally flat saddle portion, the saddle portion having no depressions or recesses therein.

It is a further object of the present invention to provide a door repair device in which self-countersinking fasteners are utilized when fastening the latch mechanism to the saddle portion of the U-shaped member.

These and other objects of the present invention will become manifest upon review of the following detailed description when taken together with the drawing.

DESCRIPTION OF THE PREFERRED EMBODIMENT

Figure 1:
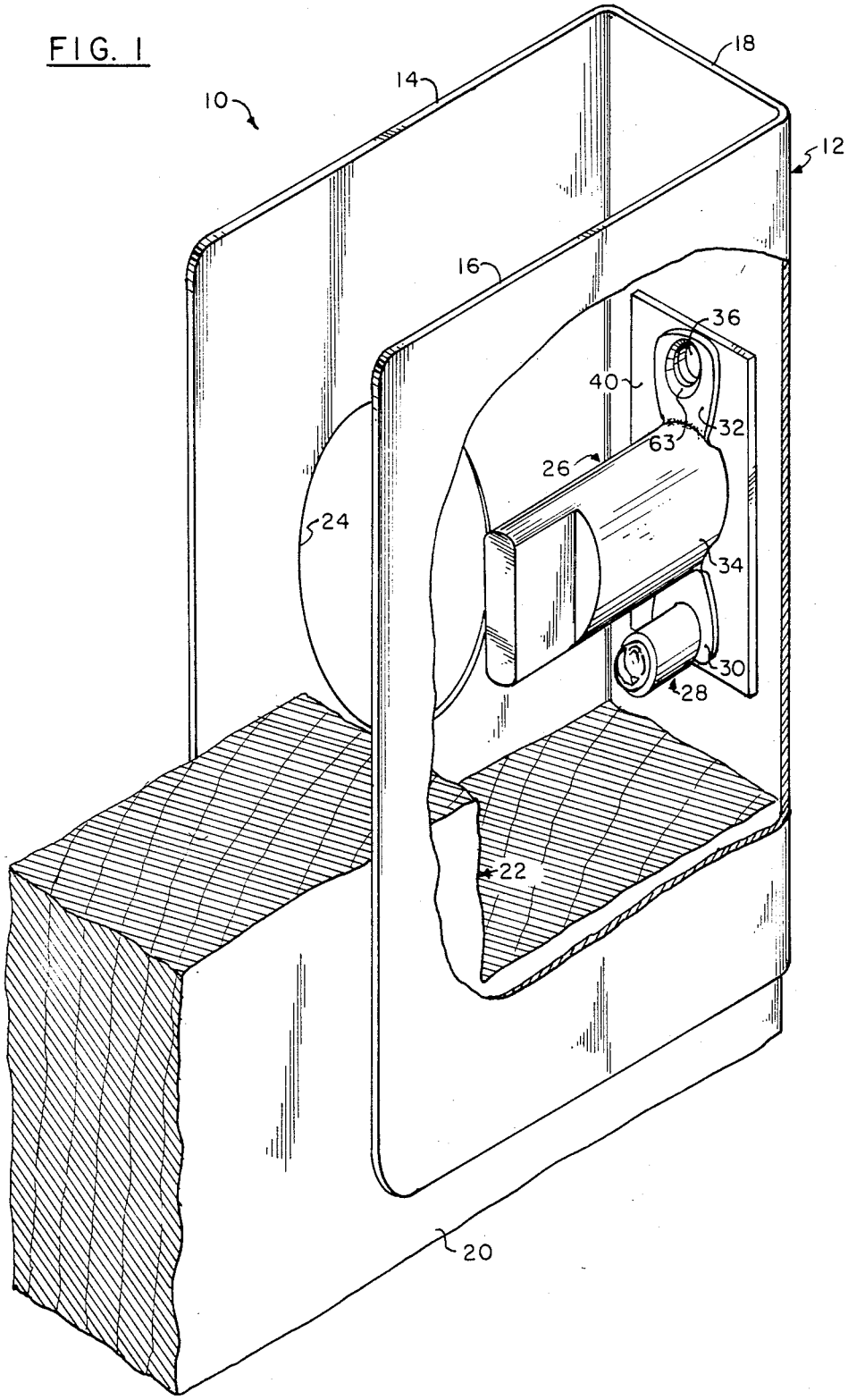
FIG. 1 is partial cut-away, isometric view of the partially assembled door repair device of the present invention.

With reference to FIG. 1, there is illustrated a partial cut-away isometric view of the door repair device 10 of the present invention comprising, basically, a generally rectangular U-shaped bracket member 12 comprising a pair of generally flat leg members 14 and 16 extending at right angles to a generally flat saddle portion 18. Generally rectangular U-shaped member 12 is adapted to fit over the edge of door 20 and be fastened thereto by screws and the like (not shown).

It will be noted that the door latch and handle area of door 20 is cut-away to define a clear area or notch 22 which is concealed by leg portions 14 and 16.

Further, a hole 24, shown in leg portion 14, is provided to receive the door handle mechanism.

A like hole (not shown) in leg portion 16 is also provided in the area of the cut-away portion.

A door latch actuating mechanism 26 is attached to saddle portion 18 utilizing connector assemble 28 in cooperation with ears 30 and 32 projecting at right angles at the base of housing of latch actuating mechanism 26. Connector assembly 28 is not shown for connecting ear 32 to saddle portion 18 in order to show the configuration and location of hole 36 in ear 32 of latch operating mechanism 26.

It will be noted also that door repair device 10 of the present further comprises a latch plate 40 sandwiched between ears 30 and 32 of housing 34 and saddle portion 18.

Figure 2:
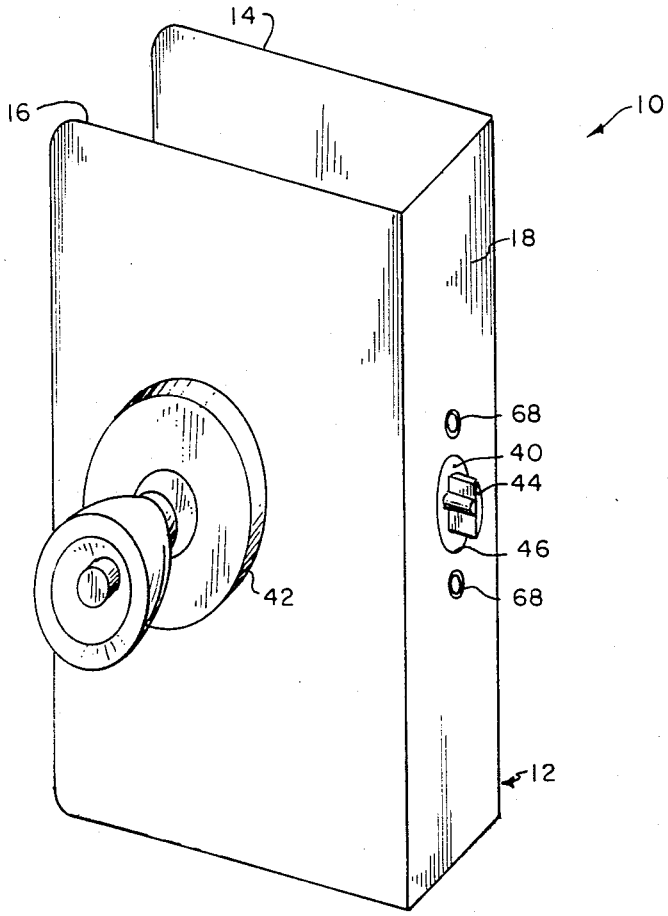
FIG. 2 is an isometric view taken from a different angle than FIG. 1 of the door repair device of the present invention showing the latch and handle members assembled on the U-shaped member.

With reference to FIG. 2, there is illustrated a further isometric view of the door repair device 10 of the present invention viewed from a different angle and showing the installation of door handle 42 relative to leg member 16. Further illustrated is the location of door latch bolt 42 which extends through latch plate 40 and hole 46 in saddle portion 18.

Figure 3:
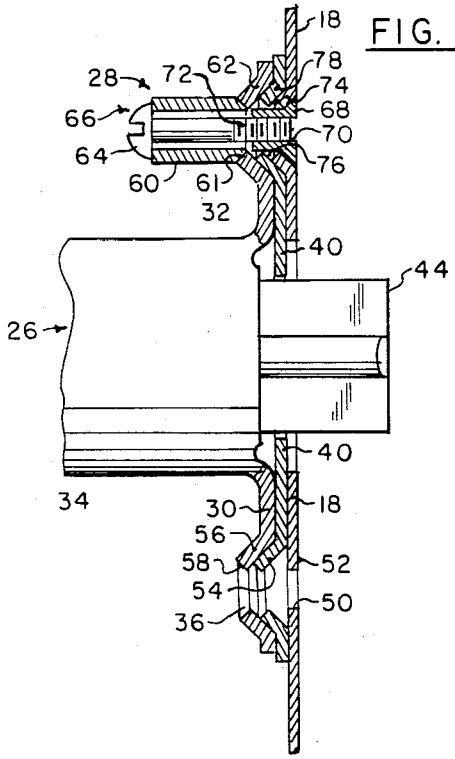
FIG. 3 is a cross-sectional, elevational view the door repair device of the present invention showing the method of connecting the latch mechanism to the U-shaped bracket member utilizing self-countersinking fasteners.

With reference to FIG. 3 there is illustrated a cross-sectional elevational view of the door protection device 10 of the present invention taken in the area of the saddle portion where latch operating mechanism 26 is attached to saddle portion 18.

In FIG. 3, ear 32 of housing 34 is shown attached to saddle portion 18 by connector assembly 28, while ear 30 is shown without connector 28 to illustrate the before and after configuration for connecting latch bolt mechanism 26 to saddle portion 18.

With particular reference to the bottom half of FIG. 3, saddle portion 18 further comprises a hole 50 having a peripheral edge portion or region 52 undeformed as shown. Latch plate 40, on the other hand, which is sandwiched between ear 30 and saddle portion 18 is provided with a countersunk region 54 projecting inwardly from saddle portion 18 to mate with a like countersunk portion 56 about hole 36 formed in ear 30 of housing 34.

This is the typical configuration of the assembled latch actuating mechanism 26 and door protecting U-shaped member 18 prior to installing fastener assembly 28.

With respect to the upper portion of FIG. 3, there is illustrated the installed configuration for connector assembly 28 which comprises a generally cylindrical extension member 60 shaped at one end 61 to engage the extended end or surface of countersunk portion 62 of ear 32 and adapted at its other end to engage the underside of head 64 of machine screw 66.

A fastening member 68 having a flat head and tapered sides is provided with a threaded hole 70 adapted to engage the threads on shank 72 of machine screw 66. Thus as machine screw 66 is turned to cause fastening member 68 to be drawn into extension member 60, the tapered sides of the head of fastening member 68 will be pressed against the peripheral region 74 about hole 76 in saddle portion 18 causing it to deform inwardly to mate with countersunk portion 78 about the hole in latchplate 40.

When fully drawn inward toward extension portion 60, the flat head of fastening member 68 will thus be flush with the outside surface of saddle portion 18.

In this manner no preliminary countersinking operation need be performed on holes 50 and 76 in saddle portion 18, thus eliminating a step in the manufacture of U-shaped member 12.

Figure 4:
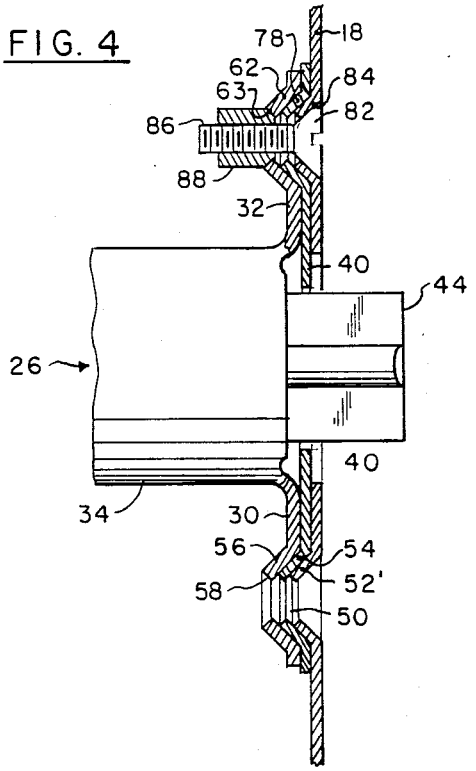
FIG. 4 is a cross-sectional, elevations view of the door repair device of of the present invention showing the method of connecting the door latch mechanism to the U-shaped bracket utilizing countersunk flathead fasteners.

FIG. 4 illustrates a further embodiment of the fastening method of the present invention comprising, basically, a flathead screw 82 having a tapered side 84 and a threaded shank 86 which is adapted to engage a fastening member 88 having a tapered surface at one end adapted to engage the end portion 63 of countersunk region 62 of ear 32. The countersunk portion 51' of hole 50 in saddle portion 18 is shown after deformation in FIG. 4 in the lower half of the Figure.

Thus is disclosed the door repair device requiring a minimum of manufacturing operations.

I claim:

1. A device for repairing a door comprising a generally rectangular U-shaped member adapted to enclose and engage the edge of a door proximate the latch and door handle location, said U-shaped member comprising a pair of leg members and a saddle portion, said saddle portion defining a generally flat surface, means defining a hole in each of said leg members adapted to receive a door handle latch actuating mechanism, means defining a hole in said saddle portion adapted to permit a latch bolt to pass therethrough, a latch plate adapted to engage the inside surface of said saddle portion between said leg members, said latch plate having means defining a hole proximate each end thereof, the region around said holes deformed to define countersunk portion projecting inwardly of said saddle portion, means defining a pair of holes in said saddle portion aligned coincident with said holes in said latch plate, a door latch apparatus housing having a pair of fastening ears proximate the base thereof, said ears comprising means defining a hole therethrough aligned coincident with said holes in said latch plate and deformed to define a countersunk area adapted to nest with said countersunk region of said latch plate hole, an extension member defining a hollow, generally cylindrical, shaft having one end adapted to engage the outwardly projecting portion of said countersunk hole in said door latch housing ears, a machine screw having a threaded shank and a head, said head adapted to engage the other end of said extension member, a fastening member comprising an internally threaded hollow shank and a flat head having tapered sides adapted to match the taper of said countersunk holes, said internal threads of said hollow shank adapted to engage the threads of said machine screw whereby, said machine screw pulls said fastener member into engagement with the edges of said hole in said saddle portion and deforms said edges to a countersunk position matching the countersunk portions of said hole in said latch plate.

2. The device for repairing a door as claimed in claim 1 wherein said countersunk holes in said ears of said door latch apparatus housing comprise an inward tapering frusto-conical surface proximate the edge of said hole facing inwards from said saddle portion, and said extension member further comprises one end defining a frusto-conical surface adapted to engage said frusto-conical surface proximate the edge of said hole in said ear of said door latch apparatus housing.

* * * * *